US005887747A

United States Patent [19]

Bürklin et al.

[11] Patent Number: 5,887,747

[45] Date of Patent: Mar. 30, 1999

[54] METHOD OF CLOSING OFF THE MOUTH OF A CONTAINER, A CONTAINER WITH A CLOSURE OF THIS KIND AND A MATERIAL FOR MANUFACTURING THE CLOSURE

[75] Inventors: Günter Bürklin; Hermann Drüssel, both of Teningen; Gottfried Haller, Endingen, all of Germany

[73] Assignee: Tscheulin-Rothal GmbH, Teningen, Germany

[21] Appl. No.: 860,867

[22] PCT Filed: Mar. 15, 1996

[86] PCT No.: PCT/EP96/01129

§ 371 Date: Sep. 23, 1997

§ 102(e) Date: Sep. 23, 1997

[87] PCT Pub. No.: WO96/30279

PCT Pub. Date: Oct. 3, 1996

[30] Foreign Application Priority Data

Mar. 24, 1995 [DE] Germany ..... 195 10 732.2

[51] Int. Cl.[6] ..... B65D 41/00

[52] U.S. Cl. ..... 220/359.2; 220/359.3; 220/359.4; 215/232; 156/244.11; 156/244.18; 156/252; 156/256; 428/78; 428/200; 428/201; 428/349

[58] Field of Search ..... 220/359.2, 359.3, 220/359.4; 215/232; 156/244.11, 244.18, 252, 253, 256; 428/78, 200, 201, 349

[56] References Cited

U.S. PATENT DOCUMENTS

| | | | |
|---|---|---|---|
| 4,636,273 | 1/1987 | Wolfersperger | 156/244.11 |
| 4,938,390 | 7/1990 | Markva | 222/206 |
| 4,960,216 | 10/1990 | Giles et al. | 215/232 |
| 5,004,111 | 4/1991 | McCarthy | 215/232 |
| 5,265,745 | 11/1993 | Pereyra et al. . | |
| 5,514,442 | 5/1996 | Galda et al. | 428/78 |
| 5,702,015 | 12/1997 | Giles et al. | 215/232 |

FOREIGN PATENT DOCUMENTS

| | | |
|---|---|---|
| 0 040 797 A1 | 12/1981 | European Pat. Off. . |
| 0 135 431 A1 | 3/1985 | European Pat. Off. . |
| 37 06 962 A1 | 9/1987 | Germany . |
| 637 855 A5 | 8/1983 | Switzerland . |

*Primary Examiner*—Stephen K. Cronin
*Attorney, Agent, or Firm*—Panitch Schwarze Jacobs & Nadel, P.C.

[57] ABSTRACT

The invention concerns a process for covering a container opening with a container cover (11), which is peelably connected to the container rim (7) surrounding the container opening. The process according to the invention is characterized in that on a first material strip (1) of the container cover (11) at least one second material strip (2) partially covering the first material strip is arranged, that subsequently both material strips (1, 2) are coated with a sealing agent (5) at least in a marginal area formed between these material strips, and that during a subsequent process step the container rim (7) surrounding the container opening is peelably connected to the first as well as the second material strips (1, 2) in a circular manner, wherein the second material strip (2) overlaps a marginal partial section of the container opening in such a way that the partial section of the first material strip (1), arranged on the side of the container cover (11) facing away from the container interior, overlapping the second material strip (2) and thus free of the sealing agent, forms a tear-open flap. The invention also concerns a container (10) with a container cover (11) as well as lid material (3) for the manufacture of a container cover (11).

14 Claims, 3 Drawing Sheets

METHOD OF CLOSING OFF THE MOUTH OF A CONTAINER, A CONTAINER WITH A CLOSURE OF THIS KIND AND A MATERIAL FOR MANUFACTURING THE CLOSURE

BACKGROUND OF THE INVENTION

The invention concerns a process for covering a container opening by means of a container cover which is connected to the container rim surrounding the container opening and which can be peeled off, wherein on a first material strip of the container cover at least one second material strip is arranged partially covering the first material strip, wherein the two material strips are connected with each other by a sealing layer at least in an edge area formed between these material strips, and wherein a partial section of the container cover, which is maintained free of the sealing layer by means of the second material strip, forms a tear-off flap.

Object of the present invention is also a container with a container cover, connected in a circular manner to the container rim surrounding a container opening, which can be peeled off and which has a first material strip as well as a second material strip, wherein these two material strips are tightly connected with each other at least in the edge regions situated between them while forming a tear-off flap.

The present invention also concerns itself with a cover material for manufacture of a container cover, which cover material has first material strip, on the side of which facing the container interior at least one second material strip is provided covering a partial section of the first material strip.

Container covers of the type mentioned above are used as lids of various designs for covering containers used for packaging.

A container whose container opening is sealed by means of a container cover consisting of aluminum foil is already known. This container cover is provided with a first layer of material which is connected tightly and in a circular manner to the container rim surrounding the container opening in a circular manner, but which cannot be peeled off. On the surface not facing the interior of the container, the first layer of material is connected with punched-out and sealed-on flaps serving to tear open the cover; these flaps are made of a second layer of material which seals off an opening for drinking provided in the first layer of material, whereby the second layer of material can be peeled off the first layer of material via a projecting partial section in the shape of a flap thus uncovering the opening for drinking.

Due to providing the opening for drinking in the first layer of material, punching out and sealing on the tear-off flap including the necessary positioning of both layers of material in relation to each other, and due to punching out the container cover, the manufacture of this cover necessitates considerable expenditure. Furthermore, there is the possibility that germs may accumulate in the space between the two layers of material arranged on top of each other, especially under the projecting partial section in the shape of a flap; these germs cannot be eliminated completely even by subjecting the lid material to an aseptic bath.

From U.S. Pat. No. 5,265,745 is already known a container cover of the type mentioned at the outset for closing a container opening, which is peelably connected with the container rim surrounding the container opening. This previously known container cover has an outer first material strip, which is connected by a full surface sealing layer with a second material strip partially covering the first material strip. The first and the second material strips are connected on their side facing the container opening by the sealing layer connecting them with each other with a further base layer, which touches on the container edge on its opposite-lying flat side by an additional hot-adhesive layer.

For this purpose, the second material layer lies loose on the base layer and is connected tightly with the first material strips by the sealing layer in such a manner that in the continuous base layer in the region of its interior separation line with the second material strips a breakthrough position is formed, which above all (as shown in FIG. 8 of U.S. Pat. No. 5,265,745) leads to a nonuniform separation line. A further disadvantage is that the manufacturer of the previously known cover material from U.S. Pat. No. 5,265,745 entails a not insubstantial expenditure on account of the many layered construction.

SUMMARY OF THE INVENTION

It is therefore a necessary object to create a process for covering a container opening, to create a container as well as a lid material for the manufacture of a container cover which do not possess the disadvantages inherent in the above-mentioned state-of-technology and which permit covering a container opening in a simple manner and with a minimum amount of expenditure.

The solution according to the invention with the process of the type mentioned at the outset consists particularly in that the two material strips, possibly with the exception of at least one strip-shaped edge surface covered between the first and the second material strips and bordering on the longitudinal sides of the second material strip, are assigned to each other without an intervening sealing layer, that the first and the second material strips are releasably connected by means of a continuous sealing layer which overlies the material strips, preferably covering their full surface, and that the container rim which delimits the container opening is peelably connected in a subsequent process step directly with the first as well as the second material strips, in such a manner that the second material strip covers a marginal partial section of the container opening, and the partial section of the first material strip which is arranged on the side of the container cover facing away from the container interior, overlapping the second material strip and thereby maintained free of the sealing layer, forms the tear-off flap.

During the process according to the invention a second material strip is arranged on a first material strip, the former overlapping the latter, prior to coating possibly the entire surfaces of the two material strips lying above each other with a sealing agent in a simple manner. During a subsequent process stage, the container rim surrounding the container opening is connected in a circular manner with the first as well as the second material strip, whereby the container opening is arranged on each of the material strips in such a way that the second material strip covers a marginal partial section of the container opening and that the partial section of the first material strip, arranged on the surface of the container cover facing away from the container interior, overlapping the second material strip and thus free of the sealing agent, forms a flap serving to tear open the cover.

The process according to the invention therefore does not necessitate either several punching-out stages or exact positioning steps with regard to the container cover and the container opening. By means of the process according to the invention, the container cover can be manufactured in an especially simple way. The process according to the invention not only permits processing of the material strips from a roll, but punched-out sections for processing can also be manufactured and delivered as staple articles.

In order to manufacture individual container lids and to process them as staple articles, it is practical that at least one container lid is punched out of the two connected material strips in such a way that this punched-out lid intersects one of the marginal areas formed between the first and the second material strips.

In an especially advantageous development according to the invention, it is provided that after the container is connected to the first material strip as well as the second strip arranged on the first strip, the container is separated from the partial sections of the material strips which project laterally beyond the container rim.

For this embodiment according to the invention, the entire flat surface of the first material strip facing the container interior is coated with a sealing agent, adjusted to the lower parts of such containers, wherein at least one second material strip at least partially overlapping the first material strip is embedded into the sealing agent in such a way that the area between the two material strips is not coated with the sealing agent. In this case the material strips may each be made of aluminum or an aluminum strip, plastic, paper or a combination of these materials, wherein the first material strip, serving as a supporting material, may be provided, if necessary, with placed or continuous printing on the surface facing away from the second material strip.

The result of embedding the second material strip or strips within the sealing agent is that the flat surface of the second material strips facing the first material strip has no direct connection with this first supporting lid material. On the other hand, there is no open cut edge. Therefore, no "dead areas" where germs may be introduced or survive are present in the aseptic bath. Due to the effects of heat during the manufacturing process, it can be assumed that these material strips and the areas provided between them are themselves free of germs as well, so that reinfections cannot occur.

When the material strips are processed from a roll of material during the process according to the invention, this material for the lids can be made sterile in a hydrogen peroxide ($H_2O_2$) bath or a similar aseptic bath and can be sealed onto the filled containers, under aseptic conditions, before the container are each separated from the partial areas of the material strips, projecting beyond the container rim, via a punching-out process. The second material strips, partially covering the first material strip and embedded into the sealing agent, are arranged in the path of lid material in such a way that on one side of each container a non-connected zone between the first material strip, which is the material supporting the lid, and the second material strip is exposed. In this case the punching out of the filled and sealed chain of containers is regularly done outside the aseptic area.

Since there is no connection between each first and second material strip, possibly with the exception of at least one strip-shaped edge surface covered between the first and the second material strips and bordering on the longitudinal sides of the second material strips, the partial area of the first material strip overlapping the second material strip can be turned up to form a tear-open flap serving to grasp the cover and can then be pulled off the container completely. The width of the second material strips limits the width of the tear-open flaps.

In order to use the longitudinal edges of the second material strips for the formation of the tear-off flaps, it is expedient if at least one container or one lid punch-out is positioned at each of the two longitudinal edges of the second material strip. A preferred embodiment according to the invention provides at least two material strips on the first material strip, arranged at a distance from each other and from the adjacent longitudinal edges; containers or lid punch-outs are then placed along both their longitudinal edges.

Implementation of the object according to the invention for the container of the kind mentioned above lies especially in the fact that the first and the second material layers, possibly with the exception of a strip-shaped edge surface covered between the first and the second material strips and bordering on the longitudinal sides of the second material strips, are assigned to each other without an intervening sealing layer, that the two material strips are releasably connected with each other by means of a continuous sealing layer covering the overlying material strips, preferably covering their full surface, that the first and the second material strips of the container cover tightly cover the respectively adjoining partial sections of the container opening, and that a partial section of the first material strip, overlapping the second material strip and arranged on the side of the second material strip facing away from the container interior, forms the tear-off flap.

The container opening of the container according to the invention is covered tightly by a first as well as a second material layer which are connected in the marginal area between them but can be separated. The partial section of the first material layer overlapping the second material layer serves here as a tear-open flap integrated within the surface. By lifting this flap, practically the entire surface of the lid can be pulled off the container according to the invention. Since the container cover of the container according to the invention does not require any tear-open flaps which project beyond the outer rim of the container, the container bottom can be punched out in one stroke together with the lid material, and an additional snap-on lid can easily be placed onto the container cover as well.

When the tear-open flap is pulled, the first material layer, connected at its edge with the container and able to be peeled off, is then pulled off the container rim, while the second material strip still remains attached to the container. Since the width of the second material layer is the same as the width required for the tear-open flap, the contents of the container can easily be drunk or spooned out in spite of the second material strip remaining on the container rim after the container cover has been pulled open.

Since the visible surface of the container cover is formed only by the first layer of material, any desired label may be printed on the outside of this container cover.

Since the first and the second material strips in the edge region situated between them are releasably connected with each other by means of a continuous sealing layer which preferably covers entirely the material strips lying over each other, the second material strip is thus practically imbedded in the sealing medium on the side of the first material strip which faces toward the container interior. When the first material layer is pulled off, the second material strips originally embedded in the sealing agent remain attached to the container, whereas the sealing agent along the strip edge provided between the first and the second layer of material is torn off.

Implementation of the object according to the invention for the lid material of the kind mentioned above is effected in particular by the fact that the first and the second material strips, possibly with the exception of at least one strip-shaped edge surface covered between the first and the second material strips and bordering on the longitudinal sides of the second material strip, are assigned to each other without an intervening sealing layer, that these overlying material layers are releasably connected with each other by means of a continuous sealing layer which preferably covers their entire surface, and that the two material strips are provided on their side covered with the sealing layer for peelable connection with the container rim.

Since the overlying material strips are connected with each by means of a continuous sealing layer, preferably covering their entire surface, it is possible to use the lid material according to the invention as a tear-open lid system suitable for the aseptic filling of the containers, and especially to use that material with aseptically-operating thermo-filling and sealing machines. This type of connection of the second material strip to the first material strip serving as supporting material does not have any open cut edges where germs and similar bacteria could otherwise establish themselves. Since the lid material becomes free of germs due to the effects of heat during the manufacturing process, and since the supporting material according to the invention has no open cut edges, the smooth outer edges of the lid material can be made sterile once more via an aseptic bath or any other process for killing germs prior to filling and sealing the containers, and before the container covers are sealed onto the filled containers in aseptic conditions.

Processing of the lid material according to the invention from a roll of material is made easier when the first material strip is connected with several second material strips arranged at a distance from each other, and when these material strips run approximately parallel to each other in the longitudinal direction.

BRIEF DESCRIPTION OF THE DRAWINGS

Further characteristics of the invention result from the following description of an embodiment according to the invention in conjunction with the claims as well as the drawings. The individual characteristics may be realized individually or in groups in the case of a construction according to the invention.

Schematically represented are.

DETAILED DESCRIPTION OF THE INVENTION

Figure 1:
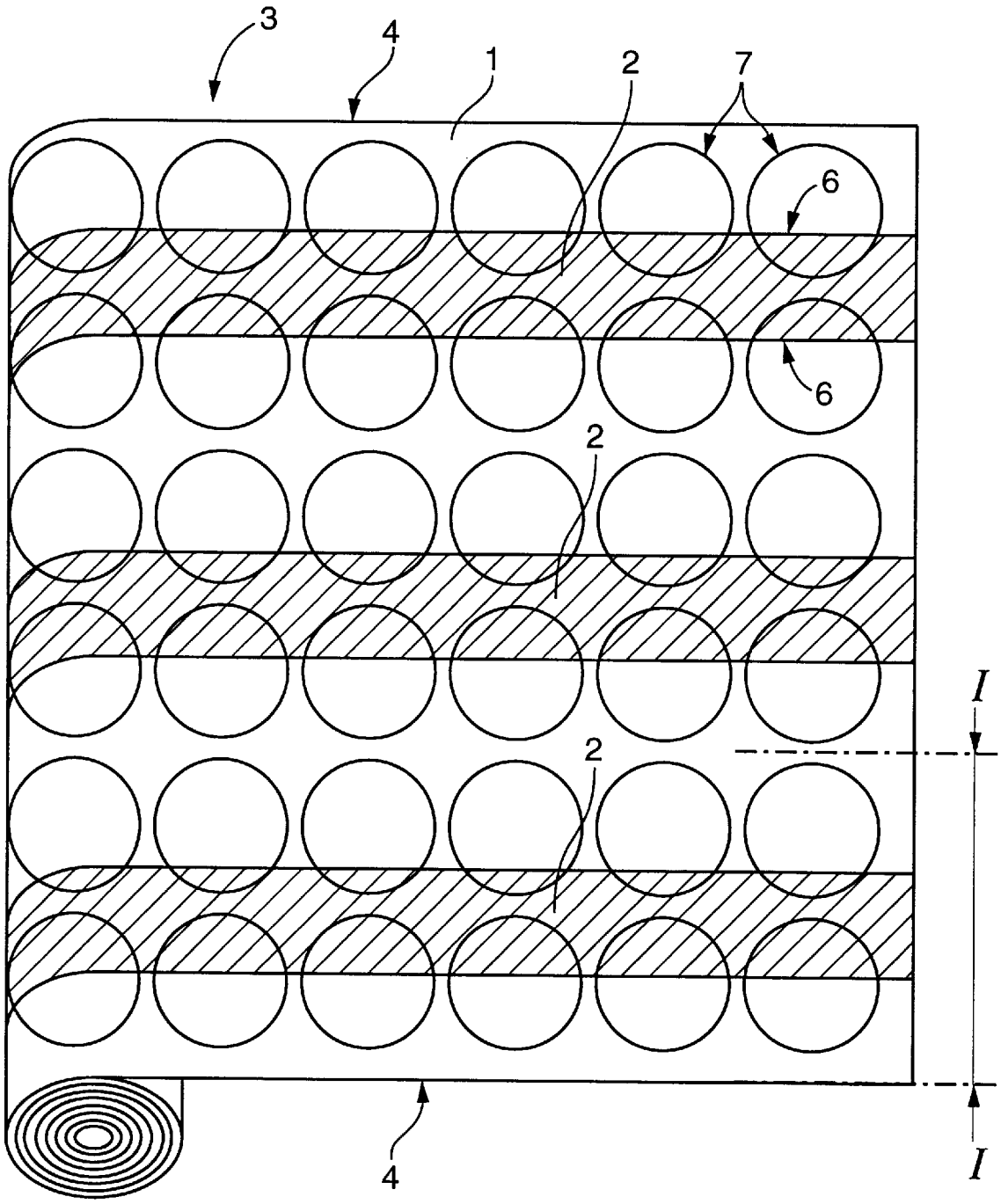
FIG. 1 showing rolled-up lid material for a six-lane method of operation for the manufacture of container covers, whereby the lid material consists mainly of a first material layer serving as a supporting material and provided with second material strips arranged at a distance from each other and from the longitudinal edges of the first material layer, FIG. 2 showing a cross section of the layer of material according to FIG. 1 in the cross sectional plane I—I from FIG. 1, FIG. 3 showing two containers whose container rims surrounding their container openings are connected with the lid material according to FIG. 1 and FIG. 2, in such a way that the lid material can be peeled off, FIG. 4 showing containers including sealed-on lid material, punched out of material according to FIG. 3, whereby one partial area each of the outer first material layer overlapping the second material layer of the container cover forms a tear-open flap, and FIG. 5 showing an approximately half open container according to FIG. 4 in a perspective representation.

FIG. 1 shows rolled-up lid material 3, intended to cover container openings. The lid material 3 according to FIG. 1 is provided with a first layer of material 1 serving as supporting material whose flat surface facing the interior of the container is provided with three second material strips 2 partially overlapping the first material layer 1. Both sides of these second material layers 2 are arranged at a distance from each other and from the longitudinal edges 4 of the first layer of material, and are releasably connected to this at their edges. For this purpose the material strips 2 are connected to the first layer of material 1 via a sealing agent, in which the second material layers of 2 are embedded. The material layers 1, 2, which may be made of aluminum or aluminum band, plastic, paper or a combination of these materials, run approximately parallel to each other in the longitudinal direction.

Figure 4:
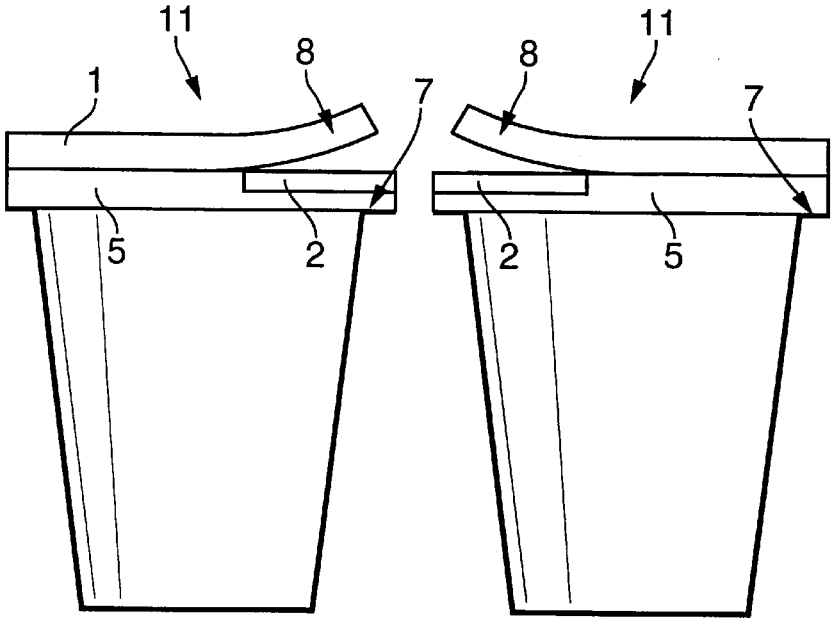
Figure 5:
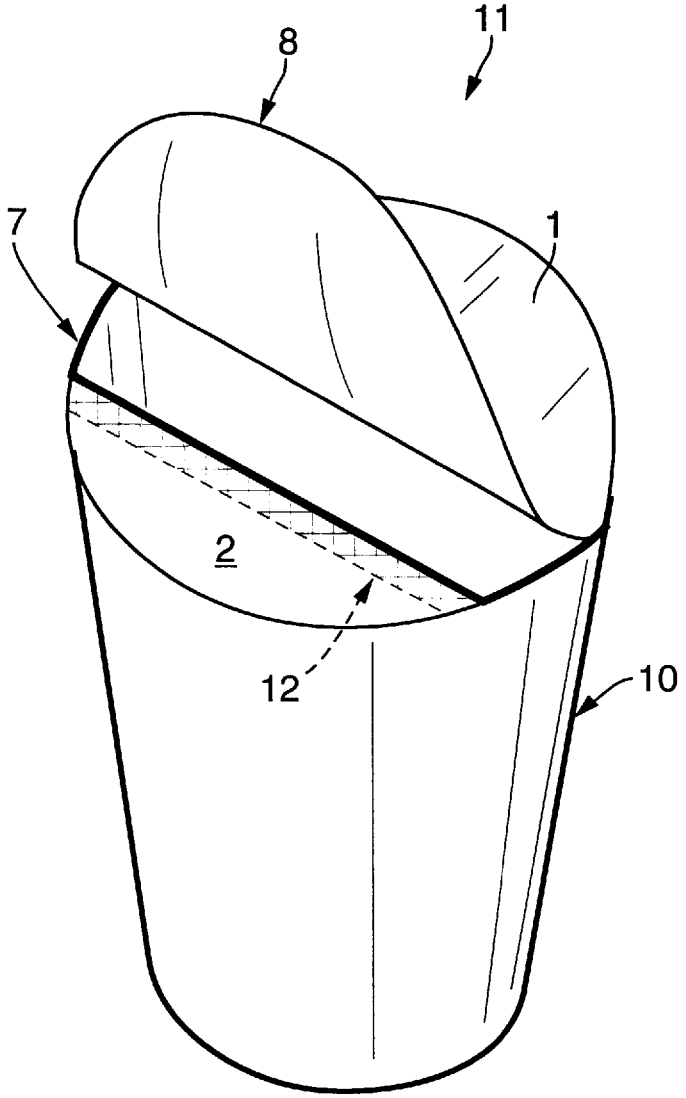

As FIG. 1 clearly shows, containers in the form of a tub or cup are placed at both longitudinal edges 6 of each second material layer 2, the containers being peelably connected at the container rim 7, surrounding a container opening, in a circular manner with the first as well as the second material strip, wherein the second material layers 2 overlap a respective marginal partial section of the container opening in such a way that the partial section of the first material strip 1, arranged on the side of the container cover facing away from the container interior, overlapping the second material strip 2 and therefore not coated with the sealing agent, forms a tear-open flap 8 (cf. FIGS. 4, 5).

Figure 2:
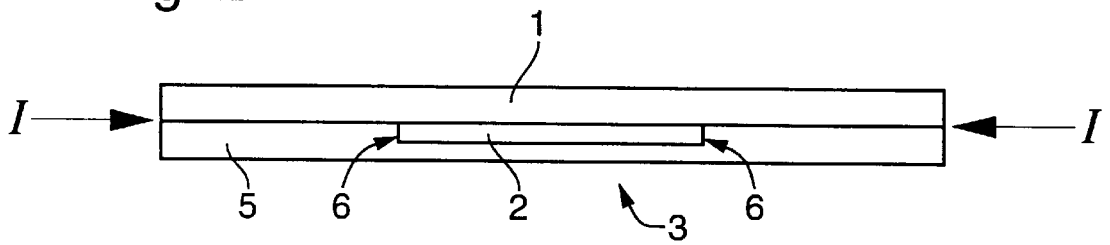

The partial cross section shown in FIG. 2 clearly shows that the second material layers 2 lying on the first layer of material 1 are practically embedded in the sealing agent 5, and are thus tightly connected at their marginal areas between both their longitudinal edges 6 and the first material strip 1 in such a way that they can be separated. The result of embedding the second material strips 2 is that the backs of these second material strips are not connected to the first layer of material 1 serving as supporting material. Thus there are no open cut edges in the area of the longitudinal edges 6 of the second material layer 2. Due to the effects of heat during the manufacturing process the lid material 3 is practically sterile in the area between the first material layer 1 and the second material strip 2 as well, therefore no re-infections can occur subsequently, due to the tight connection of these material layers 1, 2. Thus, both outer sides of the lid material 3 can once more be made sterile via a hydrogen peroxide or similar aseptic bath, or via other methods, immediately prior to sealing the lid material 3 onto the filled containers under aseptic conditions.

Figure 3:
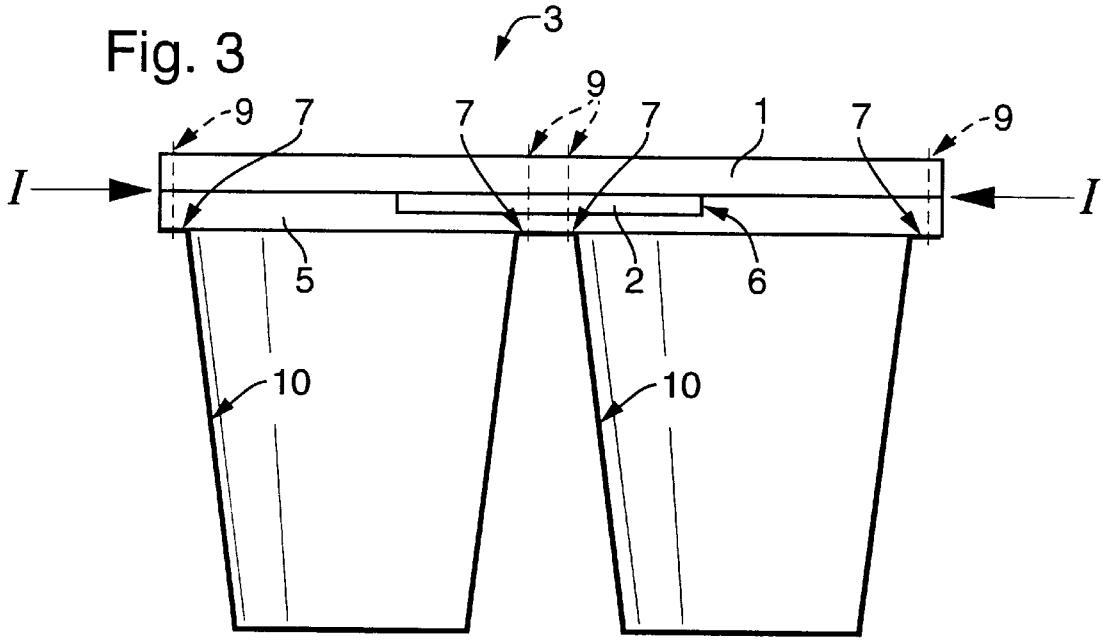

FIG. 3 shows that after embedding the second material strips 2, containers are placed on the first layer of material 1 on both sides of each second material layer 2, whereby these material layers 1, 2 respectively overlap one of the two adjoining partial areas of the container opening. The tubs 10, whose cross section is preferably circular, are separated via the punching out of the filled and sealed chain of containers at the cut-off lines 9, shown as dotted lines in FIG. 3. For this purpose, the second material strips 2 are arranged within the lid material 3, and the packaging containers 10 are placed on the lid material 3, in such a way that a non-connected zone is exposed between the first layer of material 1 and the second layer of material 2, respectively at one side of the container. Since there is no connection in this area between the first layer of material 1 and the second material strip 2, this partial area of the first layer of material 1 can be turned up as a grasping point or tear-off flap, and thus the entire first material layer of 1 can be pulled off the tub 10. The width of this tear-open flap 8 is thus defined at the same time by the width of the second material strips 2 (cf. FIGS. 4, 5).

As is clearly shown in FIG. 5, the second material strips remain attached to the tub 10 when the container cover is pulled off, whereby the sealing agent 5 is torn off along the strip edge formed between the layers 1, 2, while the first material layer 1 can be fully peeled off the tub 10. Since the width of the second material strip of each container cover is only the same as that needed for the tear-open flap 8, the contents of the tub 10 can still be easily drunken or spooned out.

If the connecting area between the first material layer 1 and the second material strip 2 has to withstand special strains and must be especially tight, it may be expedient if the first and second material strips 1, 2 are peelably connected to each other in one strip-shaped marginal area 12, covered by these two layers of material and bordering on at least one of the longitudinal edges 6 of the second material strip 2, by means of glue, lacquer, molten adhesive (hotmelt), self-adhesive gum or similar binding medium, as is indicated in FIG. 5. The width of this strip-shaped marginal area 12 covered by the material layers 1, 2 may be approximately 2 to 8 mm, preferably about 5 mm. By means of the strip-shaped marginal area 12, delimited by an appropriate binding medium, the tear-off edges between the layers of material 1, 2 can be further protected against premature leaks.

In this case it is expedient if the marginal area 12 provided between the material layers 1, 2 is already provided in the lid material intended for the manufacture of the container cover shown in FIG. 5.

The lid material 3 permits an especially economic mode of operation, since neither punching-out nor sealing processes are necessary when the lids are produced in the shape of a roll. Contrary to other already-known processes, it is not necessary with the use of material lid 3 to work with partially non-adhesive lacquers, since the material layers 1, 2 do not adhere to each other in the area of the tear-open flap 8. There are practically no restrictions to printing on lid the material 3, whereby its outer, visible material layer 1 on the container 10 is even suitable for continuous printing or specially placed logos. The tubs 10 bonded to the lid material 3 and peelably bonded to the container covers can in practice be punched out in one stroke. Since both the longitudinal edges 6 of the second material strips 2 are tightly connected via the sealing agent 5 to the first material layer 1 in such a way that they can be separated, and since any open cut edges can therefore be avoided in this area, the lid material 3, initially made sterile due to the effects of heat during the manufacturing process, can be made sterile once more via a suitable procedure during processing at the packaging machine, prior to sealing the lid material 3 onto the filled containers 10 under aseptic conditions.

We claim:

1. Process for covering a container opening by means of a container cover, peelably connected to the container rim surrounding the container opening wherein on a first material strip (1) of the container cover (11) at least one second material strip (2) partially overlapping the first material strip (1) is arranged, wherein both material strips (1, 2) at least in one marginal area formed between these material strip (1, 2) are connected with each other by a sealing layer (5), and wherein a partial section of the container cover (11), maintained free of the sealing layer (5) by means of a second material strip (2), forms a tear-off flap, characterized in that the two material strips (1, 2), possibly with the exception of at least one strip-shaped edge surface (12) covered between the first and the second material strips and bordering on the longitudinal sides (6) of the second material strip (2), are assigned to each other without an intervening coating layer, that the first and the second material strips (1, 2) are releasably connected by means of a continuous sealing layer (5) covering the overlying material strips (1, 2), preferably over their entire surface, and that the container rim delimiting the container opening is peelably connected in a subsequent process step directly with the first and the second material strips (1, 2), in such a manner that the second material strip (2) covers a marginal partial section of the container opening and the partial section of the first material strip (1), which is arranged on the side of the container cover facing away from the container interior, overlapping the second material strip (2) and thereby maintained free of the sealing layer (5), forms the tear-off flap.

2. Process according to claim 1, characterized in that at least one container lid (11) is punched out of the material strips (1, 2) connected with each other in such a way that this lid punch-out intersects one of the marginal areas formed between the first and the second material strips (1, 2).

3. Process according to claim 1, characterized in that after the container (10) has been connected with the first material strip (1) and with the second strip (2) arranged on the first, the container (10) is then separated from the partial areas of the material strips (1, 2) projecting beyond the container rim.

4. Process according to claim 1, characterized in that at least one container (10) or a lid punch-out is placed at each of the two longitudinal edges (6) of the second material strip (2).

5. Process according to claim 1, characterized in that on the first material strip (1) at least two second material strips (2) are arranged at a distance from each other and from the adjacent longitudinal edges (4), and containers (10) or lid punch-outs are placed on both longitudinal edges (6) of the second material strips (2).

6. Process according to claim 1, characterized in that the first and the second material strips (1, 2) are peelably bonded to each other in a strip-shaped marginal area (12), formed between these material layers (1, 2) and covered by them, and bordering on at least one of the longitudinal edges of the second material strip (2).

7. Container (10) with a container cover (11), produced according to claim 1, which is peelably connected with the container rim (7) surrounding the container opening and has a first material layer (1) as well as a second material layer (2) releasably connected thereto, wherein these two material strips (1, 2) are tightly connected with each other at least in the edge region situated between them while forming a tear-off flap (8), characterized in that the first and the second material strips (1, 2), possibly with the exception of one strip-shaped edge-surface (12) covered between the first and the second material strips (1, 2) and bordering on the longitudinal sides (6) of the second material strip (2), are assigned to each without an intervening sealing layer, that the two material strips (1, 2) are releasably connected with each other by means of a continuous sealing layer (5) covering the overlying material strips (1, 2), preferably over their entire surface, that the first and the second material strips (1, 2), of the container cover tightly cover respective adjoining partial sections of the container opening, and that a partial section of the first material strip (1), overlapping the second material strip (2) and arranged on the side of the container cover facing away from the container interior, is formed as a tear-open flap (8).

8. Container according to claim 7, characterized in that the first and second material strips (1, 2) are peelably connected in a strip-shaped marginal area (12), formed between and covered by these material strips (1, 2), by means of glue, lacquer, molten adhesive, self-adhesive gum or similar bonding medium.

9. Container according to claim 7, characterized in that the strip-shaped marginal area has a width of approximately 2 to 8 mm, preferably of about 5 mm.

10. Lid material (3) for manufacture of a container cover provided for the container according to claim 7, which cover material (3) has a first material strip (1), on whose side facing the container interior at least one second material strip (2) is provided covering a partial region of the first material strip (1), characterized in that the first and the second material strips (1, 2), possibly with the exception of at least one strip-shaped edge surface (12) covered between the first and the second material strips (1, 2) and bordering on the longitudinal sides (6) of the second material strip (2), are assigned to each other without an intervening sealing layer, that these overlying material strips (1, 2) are releasably connected with each other by means of a continuous sealing layer (5), preferably covering their entire surface, and that the two material strips (1, 2) are provided on their side covered by the sealing layer (5) for peelable connection with the container rim.

11. Lid material according to claim 10, characterized in that the second material strip (2) is arranged on the first material strip at a distance from the longitudinal edges (4) of this.

12. Lid material according to claim 10, characterized in that the first material strip (1) is connected with several second material strips (2), arranged at a distance from each other, and that the material strips (1, 2) run approximately parallel to each other in the longitudinal direction.

13. Lid material for lids according to one of the claim 10, characterized in that the second material strip(s) (2) are connected to the first material strip (1) by a sealing agent (5), in which the second material strip(s) (2) are preferably embedded.

14. Lid material according to one of the claim 10, characterized in that the first and the second material strips (1, 2) are peelably connected with each other in a strip-shaped marginal area (12), formed between and covered by these material layers, at least along the longitudinal edges (6) of the second material strip (2) by means of glue, lacquer, molten adhesive, self-adhesive gum or similar binding means, and that the lid material preferably has on both longitudinal edges (6) of the second material strip(s) (2) such strip-shaped marginal areas (12).

* * * * *